US005630288A

United States Patent [19]

Lasset et al.

[11] Patent Number: 5,630,288

[45] Date of Patent: May 20, 1997

[54] PROCESS FOR MANUFACTURING BIMETALLIC COINS OR MEDALS AND COINS OR MEDALS THUS OBTAINED

[75] Inventors: Michel Lasset, Paris; Maurice Mano, Audenge, both of France

[73] Assignee: Administration des Monnaies et Medailles, Cedex, France

[21] Appl. No.: 327,875

[22] Filed: Oct. 24, 1994

[30] Foreign Application Priority Data

Feb. 4, 1994 [FR] France ..... 94 01279

[51] Int. Cl.[6] ..... A44C 21/00

[52] U.S. Cl. ..... 40/27.5; 428/609

[58] Field of Search ..... 40/27.5; 428/609

[56] References Cited

U.S. PATENT DOCUMENTS

| | | | |
|---|---|---|---|
| 4,472,891 | 9/1984 | Ielpo | 40/27.5 |
| 5,094,922 | 3/1992 | Ielpo | 40/27.5 X |

FOREIGN PATENT DOCUMENTS

| | | | |
|---|---|---|---|
| 1317746 | 5/1993 | Canada | 40/27.5 |
| 0080437A1 | 6/1983 | European Pat. Off. . | |
| 0312436A1 | 4/1989 | European Pat. Off. . | |
| 0529349A1 | 3/1993 | European Pat. Off. . | |

*Primary Examiner*—Kenneth J. Dorner
*Assistant Examiner*—Cassandra Davis
*Attorney, Agent, or Firm*—Griffin, Butler, Whisenhunt & Kurtossy

[57] ABSTRACT

Coins and medals are constructed from a ring having an inner opening and an insert disposed inside the opening, the insert comprising a groove to be filled with material of the ring plastically deformed, the ring having an inner wall substantially smooth and vertical, having an initial thickness which is greater than the initial thickness of the insert and having a cross-sectional shape which is substantially trapezoidal, a small base of the trapezoid constituting the inner wall of the ring, thereby providing a plastic deformation of the material of the ring towards the insert for connecting the ring with the insert.

14 Claims, 2 Drawing Sheets

PROCESS FOR MANUFACTURING BIMETALLIC COINS OR MEDALS AND COINS OR MEDALS THUS OBTAINED

BACKGROUND OF THE INVENTION

The invention relates to a process for manufacturing bimetallic coins and medals.

Bimetallic coins or medals comprising a peripheral ring and an inner insert have already been described.

When it is desired to prepare such coins from two distinct metallic elements of which one is in the form of a ring and the other in the form of an insert, features must, of course, be used to connect these two elements. This connection must be such that, after assembly, the two elements form a single coin comprising on each of its faces the desired design or lettering, avoiding the insert pivoting about its axis inside the ring. The problem of connection of two elements of this type has been the subject of research in very different fields and various solutions have been recommended. In the more specific field of coins, a solution has been recommended in EP-A-0 080 437 for the preparation of bimetallic flans intended for mintage; the connection features described in this document are constituted by a certain number of teeth on an inner face of the ring. An inner insert is positioned so that its periphery is tangential to upper faces of the teeth and creeping or flowing of the metal of the insert is caused by pressure so that the teeth are shut up by this metal. This technique presents a certain number of drawbacks, particularly due to the necessity of having to manufacture a ring comprising the teeth and of having to effect a creeping or flowing of the metal on the surface of the coins, which may often lead to visible irregularities on the final coins obtained.

The present invention relates to a process for manufacturing bimetallic coins or medals, by connection of a ring with an insert, which overcomes the difficulties encountered when carrying out the process described in EP-A-0 080 437.

The process of EP-A-0 080 437 also conforms to the process described in JP-A-58 003 743.

The purpose of the process in accordance with this invention is to overcome the drawbacks of the known processes, and particularly to avoid the necessity of having to use two successive strikings in order to make each coin or each medal.

Another main purpose of the present invention is to solve the technical problem of finding a solution rendering the operation of assembling the two elements easier and also preferably of facilitating the minting.

SUMMARY

To achieve this purpose, the invention, in a first aspect, relates to a process for manufacturing bimetallic coins or medals, comprising the steps of: using a ring comprising an inner opening, and an insert of suitable dimensions to allow the ring to be inserted inside the inner opening, one of the ring and insert elements comprising connection features; placing the insert inside the opening of the ring; and crimping at least partly the insert and the ring due to the connection features, by causing a plastic deformation of the material of one of the ring and insert elements in the free space existing between the elements, and finally carrying out a minting operation by stamping, the ring initially having a substantially flat and substantially vertical inner wall.

According to a preferred feature, the initial thickness of the ring is greater than the initial thickness of the insert and the crimping of the ring-insert assembly and the minting of the coin are performed in one single operation by using a die whose action causes plastic deformation of material of the ring towards the insert, the stamping of the ring towards the insert and the stamping of the ring-insert assembly forming a surface of the coin or medal.

According to another preferred embodiment, the inner wall the ring defining an inner opening is substantially flat, or smooth, and vertical. This means that the inner wall defining the inner opening of the ring does not comprise any slot or any protrusion, thereby providing a very simple ring and in particular in the case of a ring whose initial thickness is greater than the initial thickness of the insert, enabling a very easy assembly of the ring and insert and the minting of the coin in one single operation.

Preferably, the ring has a transverse initial cross-section which forms a substantially trapezoidal cross-section. When trapezoidal, the small base of the trapezoid constitutes an inner periphery of the ring.

According to a preferred embodiment, the initial thickness of the ring is variable and preferably varies from the outer periphery of the ring towards its inner periphery. Preferably, the initial thickness of the ring is greater at the outer periphery with respect to the thickness at the inner periphery. This provides the preferred embodiment of a substantially trapezoidal cross-section.

According to a particular feature, the thickness is gradually decreasing from the outer periphery to the inner periphery.

According to a further preferred embodiment, the initial thickness of the insert is at the most equal to, or slightly lower than, the minimum initial thickness of the ring.

According to another preferred embodiment, the initial thickness of the inner periphery of the ring being of a value (e), the initial thickness of the ring at the outer periphery ranges between (e) and 1.2×(e).

According to another preferred embodiment, the ring is symmetrical and its upper and lower faces are inclined outwardly, said ring having a transverse cross-section which is substantially trapezoidal, the bases of a trapezoid thereof being constituted by the inner periphery and outer periphery of the ring, the inner periphery being constituted by the small base of the trapezoid.

This preferred embodiment wherein the thickness of the ring varies from the outer periphery towards the inner periphery, and preferably decreases gradually from the outer periphery, provides the unexpected technical advantage of making easier the assembling the ring with the insert, notably by making easier the positioning of the insert within the inner opening of the ring.

Furthermore, it also results, quite surprisingly, in an improved minting, especially when the minting operation is performed in one single operation, of a mechanical connection of the ring to the insert being obtained by a plastic deformation of material of the ring towards the insert.

In the present invention where the ring has an inner wall defining the inner opening substantially flat and vertical and is of greater thickness than the insert, it is preferred that the material of the ring be more easily plastically deformable to be plastically deformed prior to the insert being deformed, the minting operation providing at least partly a plastic deformation of the materials of both the ring and the insert.

According to another particular advantageous feature, notably when the requirement of an anti-rotation effect of the insert with respect to the ring appears less important, a continuous groove may be formed on the periphery of the insert instead of at least one discontinuous groove.

The invention also covers, according to a second aspect, coins or medals comprising a ring having an inner opening and an insert disposed inside the opening and connected thereto via connection features, characterized in that the ring has an inner wall defining the inner opening which is substantially flat and preferably substantially vertical. By vertical, it is meant in the specification and claims that the inner wall of the ring is substantially perpendicular to a general plane defined by the ring.

According to a preferred embodiment the initial thickness of the ring is greater than the initial thickness of the insert, the connection being obtained by plastic deformation of the material of the ring towards the insert.

Preferably, the transverse cross-section of the ring is substantially trapezoidal cross-section.

Preferred embodiments also clearly result from the preferred embodiments of the above described process.

When trapezoidal, the small base of the trapezoid constitutes the inner periphery of the ring.

Finally, the invention also covers a ring and an insert for manufacturing bimetallic coins or medals by a ring and an insert, wherein the ring has an inner wall which is substantially flat and preferably substantially vertical.

In a preferred embodiment, the initial thickness of the ring is greater than the initial thickness of the insert, preferably greater by 0.05 to 0.3 millimeter.

Preferred embodiments of the ring and of the insert clearly appear from the preceding and following description to those skilled in the art.

In order to carry out the invention, the material, shape and dimensions of the insert and of the ring must, of course, be suitably chosen. Concerning the metal, any of the metals or alloys that may be used in the mintage of coins or for making medals, may be used, but the metal, or alloy, constituting the ring should preferably be more plastically deformable than that used for the insert; in fact, it is the metal, or alloy, constituting the ring which, under the influence of pressure exerted, must deform plastically, against the insert, and preferably, has to fill at least partially the groove made in the insert, while deformation of the insert should preferably be mainly limited to superficial deformation corresponding to formation of the parts in relief and/or figures chosen for the coin or the medal. Concerning the respective shapes of the insert and the ring, inserts and rings will be used for which a clearance (distance between the outer part of the insert and the inner part of the ring) is included between about 0.05 and about 0.2 millimeter; moreover, the ring will present a thickness of 0.05 to 0.3 millimeter greater than that of the insert.

The advantages of the process according to the invention are numerous; the following will be mentioned in particular:

- the simple geometrical shape that the ring and the central insert may present;
- the ease of making discontinuous grooves or a continuous groove on the periphery of the insert,
- the possibility of a very precise adjustment of the diameter of the insert with respect to the inner diameter of the ring (a clearance between insert and ring of from 0.05 to 0.2 millimeter is permitted),
- taking into account this adjustment between the insert and ring, the slight plastic deformation to be ensured in order to cause crimping and connection of the two elements,
- the facility of obtaining a coin whose surfaces present no irregularity at the connection of the two elements.

BRIEF DESCRIPTION OF THE DRAWINGS

The following non-limiting examples illustrate the invention; these examples refer to FIGS. 1, 2, 3 and 4.

DESCRIPTION OF THE PREFERRED EMBODIMENT

Figure 1A:
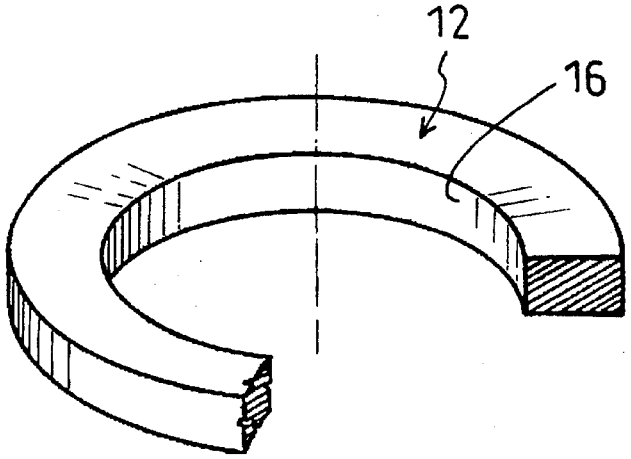
FIG. 1(*a* and *b*) are respective isometric cutaway views of two initial elements (ring and insert) which may be used for making a bimetallic coin according to this invention.

FIG. 1*a* shows in partial section a "ring"; as may be seen, this ring presents here a substantially rectangular initial cross-section. It may be seen very easily that an inner wall 16 is substantially flat, or smooth, and preferably substantially vertical. By vertical, it is meant that the inner surface 16 of the ring 12 is substantially perpendicular to a general plane defined by the ring 12. In other words, the ring does not comprise on its inner wall any slot or protrusion. It may for example have an outer diameter of 23 mm, an inner diameter of 16.5 mm and a thickness of 2.5 mm. This ring is obtained by cutting it from a band. It then undergoes the operations of annealing, dipping and polishing suitable for the alloy used.

Figure 1B:
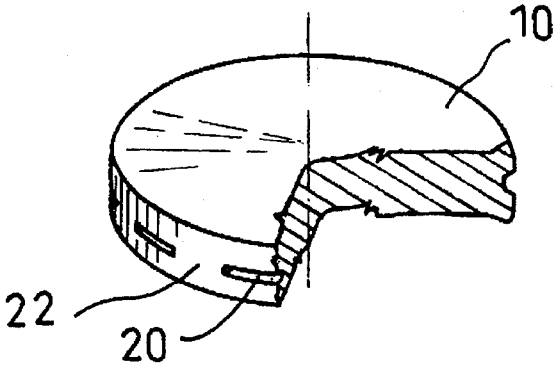

FIG. 1*b* shows an insert, which is in the form of a circular disc, obtained by cut-out, whose diameter is of 16.3 mm and whose thickness is 2.4 mm. This insert undergoes an operation of axial knurling, of the "incuse edge" type, which makes it possible to obtain a series of grooves; each groove has a maximum depth in the order of 0.2 mm. 6 or 8 grooves will for example be made over the periphery of the insert. This insert may also undergo the operations of annealing, dipping and polishing peculiar to the alloy used.

Figure 2:
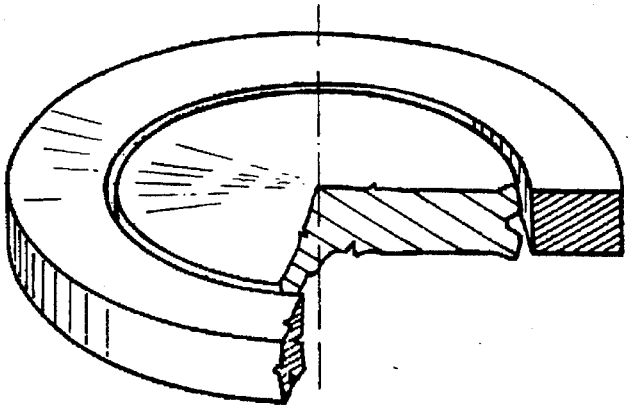
FIG. 2 is an isometric view, partially cutaway, of the two initial elements (ring and insert) suitably positioned during a step in making the coin.

FIG. 2 shows the ring and the insert which have been mechanically (and automatically) positioned with respect to each other.

Figure 3:
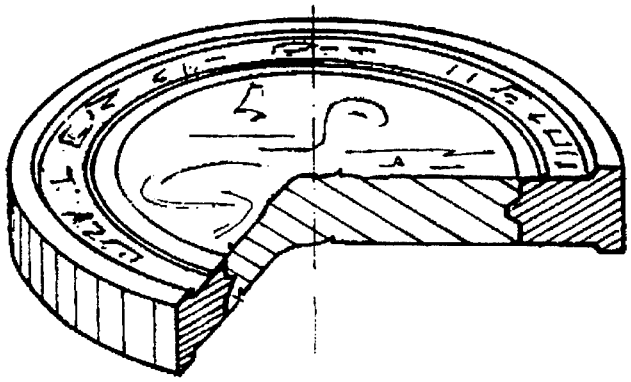
FIG. 3 is an isometric view, partially cutaway, of the finished coin.

FIG. 3 shows a finished coin, i.e. the two elements positioned as in FIG. 2 have been conveyed to striking dies; such striking having ensured crimping, obtained by plastic deformation of the metal (or alloy) of the ring towards the insert and particularly towards the grooves thereof, and mintage, in one single operation.

Figure 4:
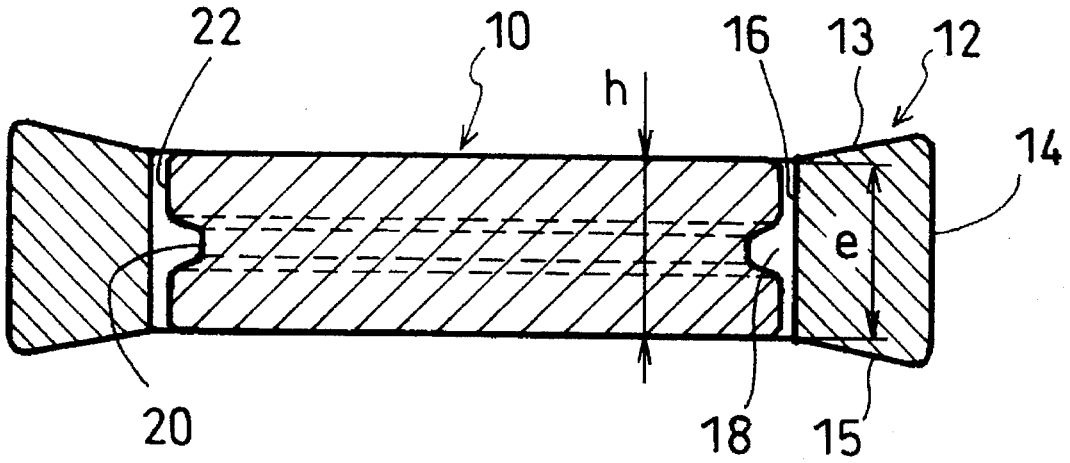
FIG. 4 is a full transverse initial cross-sectional view of a preferred embodiment of the invention showing an insert positioned inside a ring, prior to mechanical connection notably by plastic deformation of the material of one of the ring and insert.

FIG. 4, shows a best embodiment of the invention wherein an insert 10 is positioned inside a ring 12 having an inner opening 18. The ring 12 also defines an upper face 13 and a lower face 15 when placed on an horizontal surface as shown in FIG. 4.

Further, the ring 12 has an inner wall 16 which is substantially flat and vertical (parallel to an axis of the ring and perpendicular to a general plane defined by the ring).

According to this embodiment, the ring 12 has an outer periphery 14 of a thickness greater than the thickness of the inner periphery 16 defining the inner opening 18 wherein is located the insert 10.

According to the embodiment of FIG. 4, it is understood that the thickness of the ring is variable and here is gradually decreasing from the outer periphery 14 towards the inner periphery 16. This specific geometry makes it easier to position of the insert inside the inner opening 18 of the ring 12.

According to an advantageous feature, the difference between the thickness of the outer periphery 14 and the thickness of the inner periphery 18 is at the most about 0.2 times the minimum thickness of the ring, here thickness (e) of the inner periphery 16.

It is well understandable for those skilled in the art that the term "thickness" in the specification and claims means the thickness measured substantially parallel to the axis of symmetry of the ring and/or of the insert, which thickness is the height of the ring or of the insert when the ring or the insert are placed on a horizontal surface, in the position shown in FIG. 4.

Furthermore, according to the embodiment shown in FIG. 4, the outer periphery is of greater thickness as compared with the inner periphery both on the upper face 13 and the lower face 15 of the ring. Thus, the upper face 13 and the lower face 15 are inclined outwardly. The transverse initial cross-section of the ring is therefore substantially trapezoidal, the bases of the trapezoid being constituted by the inner and outer peripheries of the ring, the inner periphery being the small base of the trapezoid.

Accordingly, the total difference of the thickness when comparing the outer periphery 14 of the ring with the inner periphery of the ring is at the most 0.2 times the minimum thickness of the ring, namely 0.2×when (e) is the thickness of the ring 12 at the inner periphery 16. By such a construction it is ensured that the ring is perfectly symmetrical and may be positioned without taking care of selecting the upper face 13 or the lower face 15 which are initially identical.

The thickness (h) of the insert 10 is preferably at the most equal or slightly lower than the minimum thickness (e) of the ring 12, thereby ensuring a preferential elastic deformation of the material of the ring with regard to the material of the insert 10. To improve a mechanical connection between the insert 10 and the ring 12, the insert 10 may be provided with a groove 20 at its periphery 22.

This groove 20 may be discontinuous or continuous. Discontinuous grooves provide the essential advantage of an anti-rotation effect between the ring and the insert 10 when mechanically connected by elastic deformation of material of the ring 12 inside the grooves.

But, when such an anti-rotation effect becomes less important, then a continuous groove 20 may be used as shown in FIG. 4, the mechanical connection being performed, similarly to the discontinuous grooves, by having material from the ring 12 filling the space left in the insert 10 by groove 20.

The invention also covers coins, medals or pieces, like game pieces per se.

Further to a preferred embodiment the ring and insert for manufacturing bimetallic coins or medals are characterized in that the ring has an inner wall substantially flat and preferably vertical.

According to a preferred embodiment, the ring has a thickness which is greater than the initial thickness of the insert, preferably greater than 0.05 to 0.3 millimeter.

Further to another preferred embodiment 19 the ring and insert for manufacturing bimetallic coins or medals is characterized in that the ring is initially of substantially trapezoidal cross-section, the small base of the trapezoid constituting the inner periphery of the ring.

Furthermore, the structure of the coins, medals or game pieces of the embodiments shown in FIGS. 1 to 4 in an integral part of the invention and therefore constitutes an integral part of the specification.

The invention also covers any features which appear to be new over any prior art, from the content of the specification, including the drawings, taken as a whole.

We claim:

1. A set of elements used for making a substantially flat bimetallic coin or medal comprising a metallic ring having an inner opening and a metallic insert for being disposed inside said opening and one of said rings and said inserts including a connection means for connecting said insert to said ring, wherein the ring has a substantially trapezoidal cross-sectional shape with a small base of a trapezoid thereby formed constituting an inner peripheral wall defining the inner opening of the ring and a large base of the trapezoid constituting an outer peripheral wall of the ring, the ring having upper and lower faces which are inclined outwardly toward said outer peripheral wall, the thickness of the ring varying substantially gradually and evenly from its outer peripheral wall to its inner peripheral wall.

2. A set of elements as in claim 1 wherein the ring has a thickness in a direction perpendicular to a general plane of the ring which is greater than the thickness of the insert, and wherein said connection means is an irregularity at an outer edge of said insert for engaging with material of the ring when said ring is plastically deformed toward the insert.

3. A set of elements as in claim 2 wherein said irregularity comprises at least one discontinuous groove formed on a periphery of the insert which is for being filled with said material of the ring which is to be deformed plastically toward the insert.

4. A set of elements as in claim 3 wherein the discontinuous groove comprises from 6 to 8 groove sections formed on the periphery of the insert, each groove section having a maximum depth of about 0.2 millimeter.

5. A set of elements as in claim 1 wherein a thickness in a direction perpendicular to a general plane of the ring of the small base of the ring is between 0.005 and 3 tenths of a millimeter greater than that of the insert.

6. A set of elements as in claim 1 wherein a play between the ring and the insert is between about 0.05 and 0.2 millimeter.

7. A set of elements as in claim 1 wherein a thickness in a direction perpendicular to a general plane of the ring of the inner peripheral wall of the ring is of a value (e), with a thickness of the outer peripheral wall being greater than (e) but not substantially greater than 1.2 times (e).

8. A set of elements as in claim 7 wherein the ring is symmetrical.

9. A set of elements as in claim 1 wherein the inner peripheral wall of said ring is substantially smooth and substantially perpendicular to a general plane of the ring.

10. A substantially flat bimetallic medal constructed by the process of:

providing a metallic ring having an inner opening, said metallic ring having a substantially trapezoidal cross-sectional shape, with a small base of a trapezoid thereby formed constituting an inner peripheral wall of the ring at said opening and a large base of the trapezoid constituting an outer peripheral wall of the ring, the ring having upper and lower faces which are inclined outwardly toward said outer peripheral wall, the thickness of the ring varying substantially gradually and evenly from its outer peripheral wall to its inner peripheral wall;

providing a flat metallic insert whose outer peripheral edge fits, with play, inside said inner opening of said ring, one of said ring and said insert including a connection means for connecting said insert and said ring;

placing the insert in the opening;

crimping the trapezoidal-shaped ring with striking dies thereby crimping and flattening said trapezoidal-shaped ring and thereby causing plastic deformation of the metal forming said ring so that said inner peripheral wall is moved toward, and contacts, the outer peripheral edge of said insert so that said connection means connects said ring and insert together.

11. A medal as in claim 10 wherein said inner peripheral wall of said ring provided has a dimension in a direction perpendicular to a general plane of the ring which is substantially greater than a dimension of the outer peripheral edge of said insert provided in a direction perpendicular to general plane of the insert.

12. A medal as in claim 10 wherein said inner peripheral wall of said ring is substantially smooth and substantially perpendicular to a general plane of the ring, and wherein the connection means is an irregularity at the outer peripheral edge of said insert for engaging with material of the ring when the ring is plastically deformed toward the insert.

13. A set of elements used for making a substantially flat bimetallic coin and medal comprising a metallic ring having an inner opening and a metallic insert for being disposed inside said opening, wherein the ring has a substantially trapezoidal cross-sectional shape with a small base of a trapezoid thereby formed constituting an inner peripheral wall of the ring and a large base of the trapezoid constituting an outer peripheral wall of the ring said ring and said insert each including connection means for connecting said ring to said insert the ring having upper and lower faces which are inclined outwardly toward said outer peripheral wall, the thickness of the ring varying substantially gradually and evenly from its outer peripheral wall to its inner peripheral wall.

14. A substantially flat bimetallic medal constructed by the process of:

providing a metallic ring having an inner opening, said metallic ring having a substantially trapezoidal cross-sectional shape, with a small base of a trapezoid thereby formed constituting an inner peripheral wall of the ring at said opening and a large base of the trapezoid constituting an outer peripheral wall of the ring, the ring having upper and lower faces which are inclined outwardly toward said outer peripheral wall, the thickness of the ring varying substantially gradually and evenly from its outer peripheral wall to its inner peripheral wall;

providing a flat metallic insert whose outer peripheral edge fits, with play, inside said inner opening of said ring; said ring and said insert each including connection means for connecting said ring to said insert;

placing the insert in the opening;

crimping the trapezoidal-shaped ring with striking dies thereby crimping and flattening said trapezoidal-shaped ring and thereby causing plastic deformation of the metal forming said ring so that said inner peripheral wall is moved toward, and engages, the outer peripheral edge of said insert so that said ring and insert are connected together.

* * * * *